United States Patent [19]

Matsubara et al.

[11] Patent Number: 4,590,879

[45] Date of Patent: May 27, 1986

[54] THREAD FEED DEVICE IN A SEWING MACHINE

[75] Inventors: Toru Matsubara, Tokyo; Ikuro Iimura, Kanagawa; Kuniharu Sakuma; Sumio Goto, both of Tokyo, all of Japan

[73] Assignee: Tokyo Juki Industrial Co., Ltd., Chofu, Japan

[21] Appl. No.: 551,854

[22] Filed: Nov. 15, 1983

[51] Int. Cl.[4] ..... D05B 47/04; D05B 49/00

[52] U.S. Cl. ..... 112/278; 112/242

[58] Field of Search ..... 112/278, 241, 242, 243, 112/302, 244, 245, 254, 255

[56] References Cited

U.S. PATENT DOCUMENTS 2,347,761 5/1944 Bedard ..... 112/242
2,626,580 1/1953 Koenig ..... 112/242
3,641,958 2/1972 Trageser ..... 112/241
4,215,641 8/1980 Dobrjanskyj et al. ..... 112/278

FOREIGN PATENT DOCUMENTS 59-37985 3/1984 Japan ..... 112/278
59-62089 4/1984 Japan ..... 112/278

*Primary Examiner*—Peter Nerbun
*Attorney, Agent, or Firm*—Yount & Tarolli

[57] ABSTRACT

A thread feed device in a sewing machine is disclosed herein. The device comprises a thread paying-out member positioned in the thread path between the bobbin and needle, a pair of holding means positioned upstream and downstream of the paying-out member in the thread path and a control circuit for controlling of the operation of the holding means.

7 Claims, 14 Drawing Figures

THREAD FEED DEVICE IN A SEWING MACHINE

BACKGROUND OF THE INVENTION

This invention relates to a thread feed device in a sewing machine which pays the thread out of the thread supply source before the thread take-up lever picks the thread up each time one stitch has been formed and more particularly, to a thread feed device which precisely pays the thread out of the supply source by a predetermined length or amount to thereby maintain a constant tension on the thread to produce a high quality sewn product.

SUMMARY OF THE INVENTION

The above and other objects and attendant advantages of the present invention will be more readily apparent to those skilled in the art from a reading of the following detailed description in conjunction with the accompanying drawings which show preferred embodiments of the present invention for illustration purpose only, but not for limiting the scope of the same in any way.

DETAILED DESCRIPTION OF THE PREFERRED EMBODIMENTS

Figure 3:
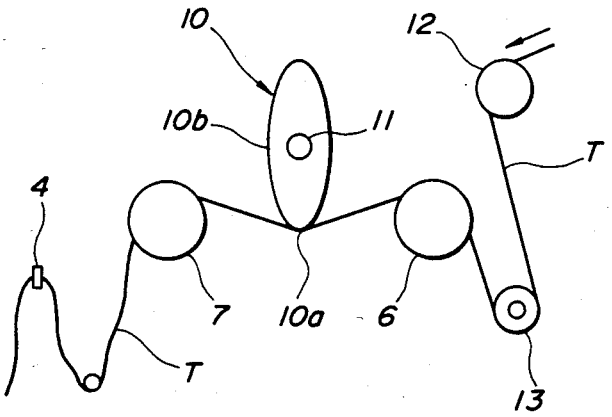
FIGS. 3 and 4 are views showing the operation of the thread feed device of FIG. 1.
Figure 4:
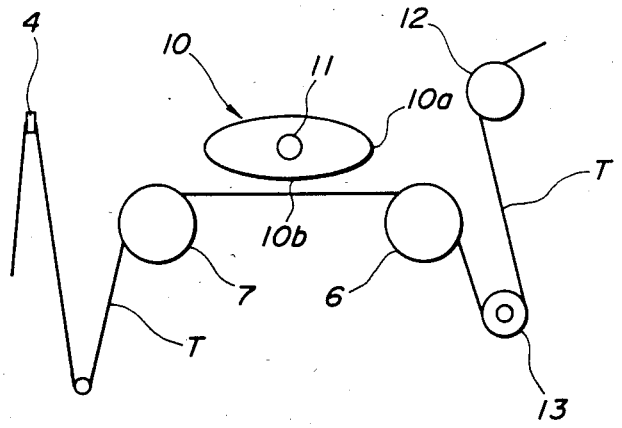
Figure 5:
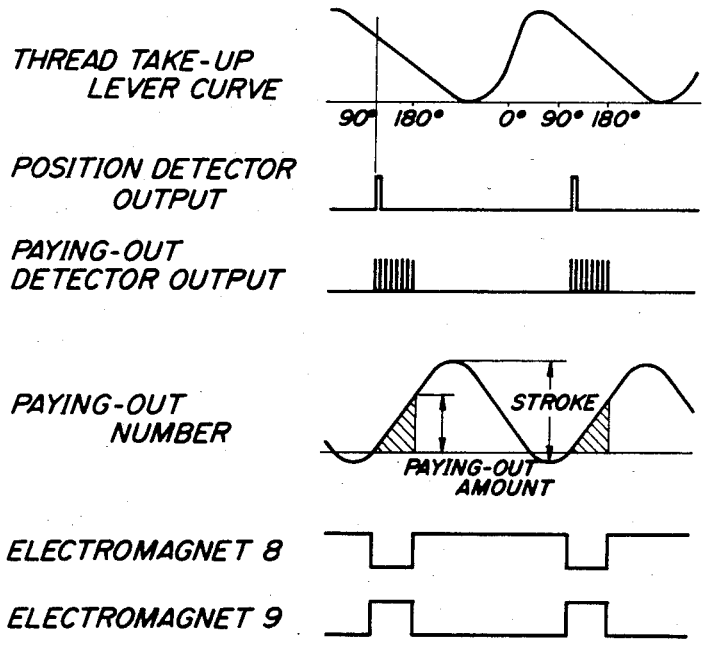
FIG. 5 is a time chart showing the operation of the electrical circuit of FIG. 2.

The present invention will be now described referring to the accompanying drawings and more particularly, to FIGS. 1 through 5 in which the first embodiment of the thread feed device in a sewing machine of the invention is shown. The sewing machine incorporates therein the main shaft (not shown) adapted to rotate in response to the operation of the drive source (not shown). The needle bar 2 is adapted to move vertically in response to the rotation of the main shaft and has the needle 3 for holding the thread T secured thereto. The thread take-up lever 4 supports the portion of the thread T extending between the bobbin 5 as the thread supply source and the needle 3 and is adapted to move vertically in response to the rotation of the main shaft so as to apply a tension to and slacken the thread T. The thread take-up lever 4 reciprocally moves between two positions describing the timing curve (thread take-up lever curve) with the top dead center at 0° as shown in FIG. 5.

Holding means 6 and 7 are provided and the holding means 6 comprises a pair of clamp members 6*a*, 6*b* and an electromagnet 8 integral with the clamp member 6*b* whereas the holding means 7 comprises a pair of clamp members 7*a*, 7*b* and an electromagnet 9 integral with the clamp member 7*b*. The holding means 6 and 7 are positioned upstream and downstream, respectively, of a thread paying-out member 10 of which description will be made hereinbelow in the thread path extending between the bobbin 5 and thread take-up lever 4. The holding means 6 and 7 are adapted to close their clamp members 6*a*, 6*b* and 7*a*, 7*b*, respectively, when their electromagnets 8 and 9 are energized, respectively, to pinch the thread T between the clamp members 6*a*, 6*b* and 7*a*, 7*b*, respectively, so as to arrest the movement of the thread T and open their clamp members 6*a*, 6*b* and 7*a*, 7*b* when the electromagnets 8 and 9 are deenergized to release the thread T so as to allow the thread T to advance.

The thread paying-out member 10 integrally comprises a larger diameter portion 10*a* and a smaller diameter portion 10*b* and rotates about its shaft 11 at an angular velocity one half of the rotation rate of the main shaft 1 as the shaft rotates so that when the thread take-up lever 4 is in its thread slackening position the larger diameter portion 10*a* engages the thread extending between the holding means 6 and 7 so as to flex the thread and when the lever 4 is in its tension applying position the smaller diameter portion 10*b* faces the thread T so as not to flex the thread.

Positioned in the thread path extending between the holding means 6 and bobbin 5 is a base tension 12 which is adapted to always apply a constant tension to the thread T. Also positioned in the thread path between the base tension 12 and holding means 6 is a rotary member 13 which rotates by an angular distance in proportion to the paying-out amount of the thread T when the thread T is fed from the base tension 12 towards the thread take-up lever 4.

Figure 1:
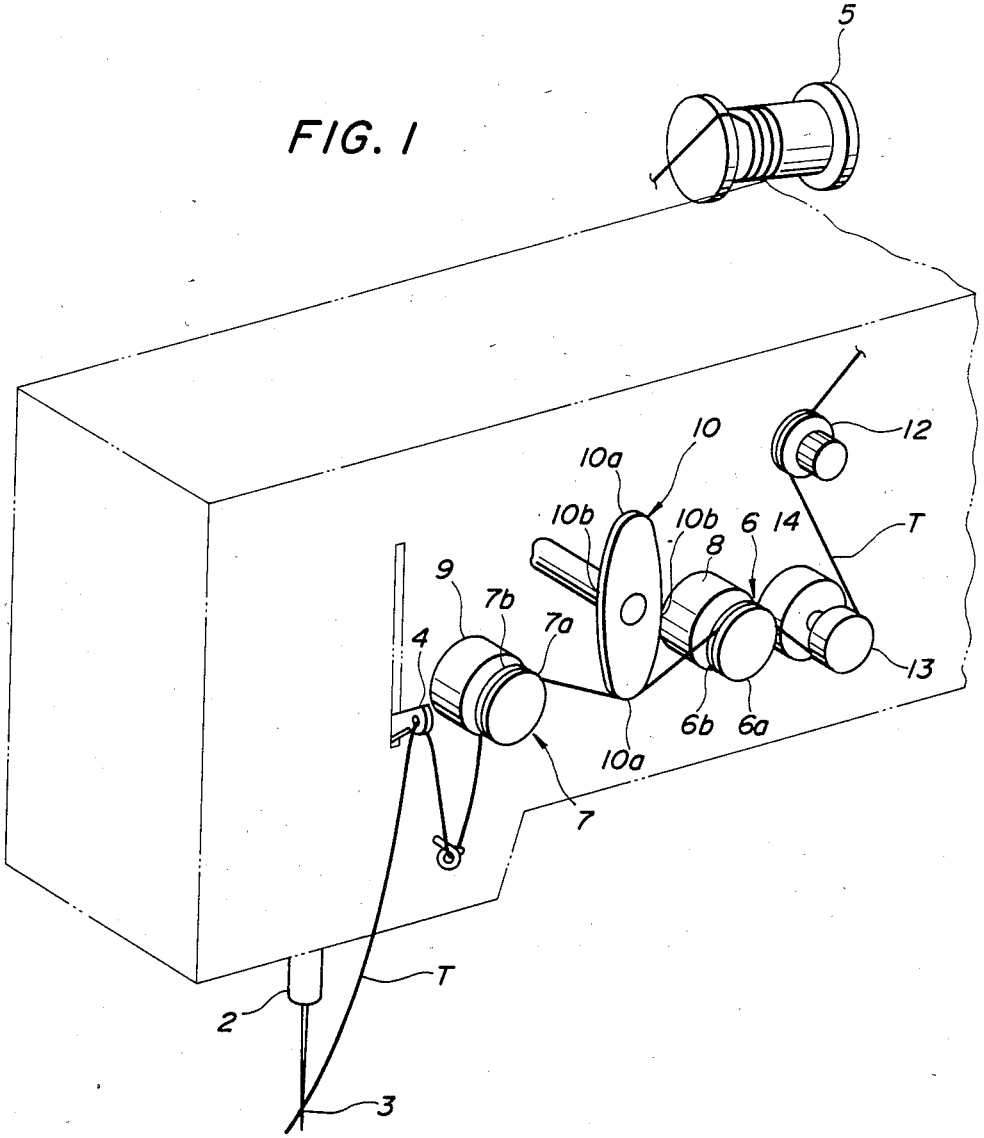
FIG. 1 is a schematic perspective view of a first embodiment of the thread feed device in a sewing machine constructed in accordance with the principle of the present invention.
Figure 2:
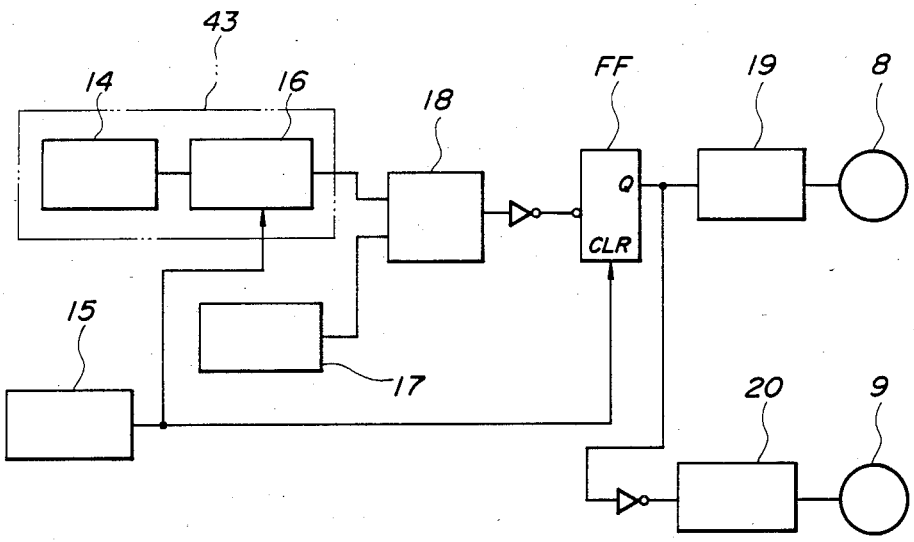
FIG. 2 is a block diagram of the electrical circuit for the thread feed device of FIG. 1.

Now the electrical circuit for the thread feed device as shown in FIG. 1 will be described referring to FIG. 2.

A paying-out detector 14 is adapted to produce one pulse each time when the rotary member 13 rotates by a predetermined angular distance and a position detector 15 is interlocked with the main shaft so that the detector detects the rotation angle of the main shaft (115° in the illustrated embodiment) and produces a position signal when the thread take-up lever 4 begins to descend and the thread T begins to slacken after one stitch has been formed. A counter 16 is set by the position signal from the position detector 15 and counts clock pulses from the paying-out detector 14. A setting device 17 comprises a digital switch to be set by a dial and is adapted to set the length or amount of the thread T to be payed out of the bobbin 5 in proportion to the amount of the thread T required for forming one stitch (the required thread amount varies depending upon the thickness of the work piece to be sewn, the stroke of the needle and the feed pitch) and produce a digital code which varies depending upon the set paying-out amount of the thread T. The digital code is related to the number of clock pulses from the paying-out detector 14 corresponding to the rotation amount of the rotary member 13 in proportion to the paying-out amount.

A comparator circuit 18 compares the output of the counter 16 with that of the setting device 17 and produces a coincidence signal when the two outputs coincide with each other. Operation circuits 19 and 20 are adapted to energize the electromagnets 8 and 9 of the holding means 6 and 7, respectively, when the circuits are closed and deenergize the electromagnets 8 and 9, respectively, when the circuits are opened. A flip-flop FF (which will be referred to as "FF" hereinafter) is of JK type and adapted to be reset by a position signal from the position detector 15 to produce the output for opening the operation circuit 19 at the terminal Q and invert the output at the terminal Q by the coincidence signal from the comparator circuit 18 to close the operation circuit 19.

In the operation of the sewing machine, when the thread take-up lever 4 descends from the top dead center and the portion of the thread T positioned nearer to the needle 3 than to the holding means 7 begins to slacken, the position detector 15 produces a position signal to reset the counter 16 and FF whereby the operation circuit 19 opens to deenergize the electromagnet 8 to cause the holding means 6 to release the thread T and the operation circuit 20 closes to energize the electromagnet 9 which in turn causes the holding means 7 to pinch the thread T so as to arrest the movement of the thread. Substantially at the same time, the paying-out member 10 rotates from the position thereof as shown in FIG. 4 in the clockwise direction to cause the larger diameter portion 10*a* of the paying-out member 10 to gradually flex the path of the thread T to the condition of the path as shown in FIG. 3 to increase the length of the thread path between the holding means 6 and 7 whereby the thread T is payed out of the bobbin 5 by the amount corresponding to the increasement in length of the thread portion between the holding means 6 and 7.

As the thread T is payed out of the bobbin 5 in the manner mentioned hereinabove, the rotary member 13 is rotated in the clockwise direction as seen in FIG. 1 and the paying-out detector 14 produces clock pulses in the number corresponding to the rotation angle of the rotary member 13. The clock pulses from the paying-out detector 14 are counted by the counter 16 and the count from the counter is input to one of the inputs of the comparator circuit 18. When the count of the counter 16 coincides with the output of the setting device 17, the comparator circuit 18 produces a coincidence signal to thereby set the FF and invert the output at the terminal Q of the FF whereby the electromagnet 8 is energized to cause the holding means 8 to pinch the thread T so as to arrest the movement of the thread and the electromagnet 9 is deenergized to cause the holding means 7 to release the thread T to allow the thread to advance. When the thread T has been payed out by a predetermined amount and the holding means 6 has pinched the thread T before the paying-out member 10 rotates by about 90° from the position as shown in FIG. 3 to the position as shown in FIG. 4, simultaneously, since the holding means 6 releases the thread T and the thread take-up lever 4 has slackened the portion of the thread T positioned nearer to the needle 3 than to the holding means 7 and thus, as the paying-out member 10 rotates, the portion of the thread T positioned nearer to the needle 3 than to the holding means 7 merely passes through the holding means 7 to the paying-out member 10 until the thread T assumes the condition as shown in FIG. 3 and will not be applied a high tension thereto between the holding means 6 and 7 and/or payed out of the bobbin 5.

Next as the thread take-up lever 4 begins to rise from the bottom dead point, the portion of the thread T between the needle 3 and holding means 6 is gradually pulled up to form a seam. Thereafter, each time the main shaft makes one complete rotation, the above-mentioned procedure is repeated and each time one seam is formed, a necessary amount of the thread T is payed out of the bobbin 5.

Figure 6:
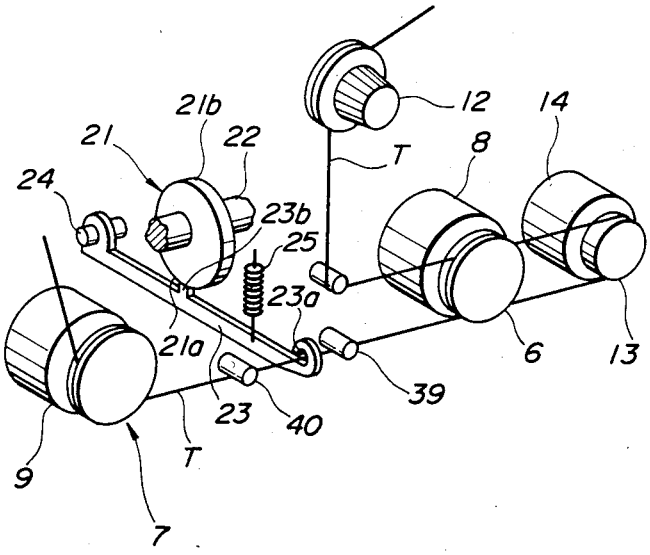
FIG. 6 is a schematic perspective view of a second embodiment of the thread feed device in a sewing machine constructed in accordance with the principle of the present invention.
Figure 7:
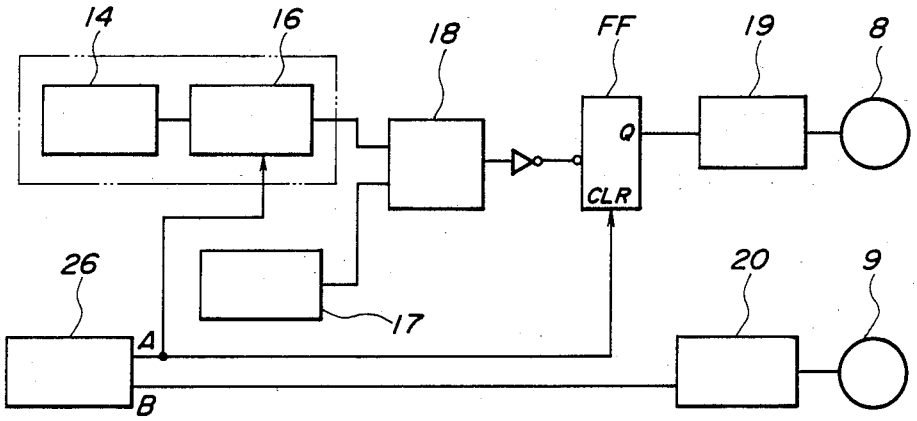
FIG. 7 is a block diagram of the electrical circuit for the thread feed device of FIG. 6.
Figure 8:
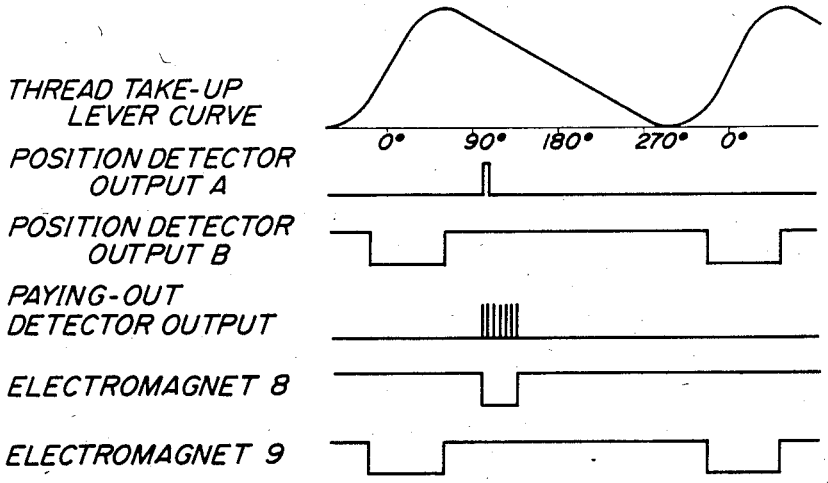
FIG. 8 is a time chart showing the operation of the electrical circuit of FIG. 7.

Now referring to FIGS. 6 through 8 in which the second embodiment of the thread feed device of the present invention is shown. In the second embodiment, the components corresponding to those of the first embodiment are affixed thereto the same numerals as those employed for the corresponding components of the first embodiment and description on the corresponding components will be omitted herein. Reference numeral 21 denotes a cam member secured to the main shaft 22 of the sewing machine and including a larger diameter portion 21*a* and a smaller diameter portion 21*b* which are integrally connected together by a smooth intermediate circular portion to form the cam face. Reference numeral 23 denotes a paying-out member corresponding to the paying-out member 10 in the first embodiment and the paying-out member 23 is supported at the base end on the machine frame for rotation about a shaft 24 which extends in parallel to the main shaft 22 and the free end of the paying-out member is formed with a thread eyelet 23*a* through which the thread T passes freely. A projection 23*b* extends upwardly from the member 23 in the center thereof. A coil spring 25 is anchored at the opposite ends to the machine frame and paying-out member to normally urge the projection 23*b* against the cam face on the cam member 21. The cam member 21 and paying-out member 23 are so related to each other that when the thread take-up lever (not shown) is in its thread slackening position the paying-out member 23 rotates in the counter-clockwise direction as seen in FIG. 6 following the cam face on the cam member 21 under the force of the coil spring 25 and when the thread take-up lever is in its tension applying position the paying-out member 23 rotates in the clockwise direction under the action of the cam member 21 against the force of the coil spring 25. The components described above are so arranged that as the paying-out member 23 rotates in the counterclockwise direction from the condition in which the paying-out member is in contact with the larger diameter portion 21*a* of the cam member 21 to the condition in which the paying-out member is in contact with the smaller diameter portion 21*b* of the cam member 21, the length of the portion of the thread T extending between the holding means 6 and 7 is increased. Reference numeral 26 (FIG. 7) denotes a position detector corresponding to the position detector 15 in the first embodiment, but the position detector 26 includes a first portion A adapted to detect the rotation angle of the main shaft 22 (about 110°) and produce a first position signal when the thread take-up lever descends and the thread T begins to slacken after one stitch has been formed and a second portion B adapted to detect the rotation angle range of the main shaft (about 350°–70°) within which the thread take-up lever rises to increase the tension on the thread T and produce a second position signal. Reference numerals 39 and 40 denote thread guides secured to the machine frame.

The operation of the second embodiment of the thread feed device of the invention will be now described referring to FIG. 7 in the electrical circuit for the second embodiment is shown. The operation circuits 19, 20 are normally in the closed condition to energize the electromagnets 8 and 9 so that the holding means 6 and 7 pinch the thread T to arrest the movement of the thread T. Next, when the thread take-up lever descends from the upper dead center and the portion of the thread T positioned nearer to the needle than to the holding means 7 begins to slacken, the first portion A of the position detector 26 produces a first position signal which resets the counter 16 and FF whereby the operation circuit 19 opens to deenergize the electromagnet 8 and cause only the holding means 6 to release the thread T. Substantially simultaneously, the paying-out member 23 rotates in the counter-clockwise direction following the cam member 21 to gradually deflect the thread path extending between the holding means 6 and 7 to extend the thread path between the holding means and thus, the thread T is payed out of the bobbin (not shown) by the amount corresponding to the increase in length of the thread path.

As the thread T is payed out of the bobbin, when the count of the counter 16 coincides with the output of the setting device 17, the FF sets to invert the output at the terminal Q of the FF and thus, the electromagnet 8 is again energized to cause the holding means 6 to pinch the thread T so as to arrest the movement of the thread whereby the electromagnets 8 and 9 are energized to cause both the holding means 6 and 7 to pinch the thread. Thus, when the thread T has been payed out of the bobbin by a predetermined amount before the paying-out member 21 faces the smaller diameter portion 21*b* of the cam member 21, the paying-out member 23 is held under the tension of the thread T against the force of the coil spring 25 in the position to which the member 23 had rotated when the electromagnet 8 was energized.

When the thread take-up lever begins to rise from the bottom dead point to pull the thread T up, the second portion B of the position detector 26 produces a second position signal which opens the operation circuit 20 for the electromagnet 9 to deenergize the electromagnet whereby the rising thread take-up lever pulls up the thread payed out by the paying-out member 23 to form a stitch.

Figure 9:
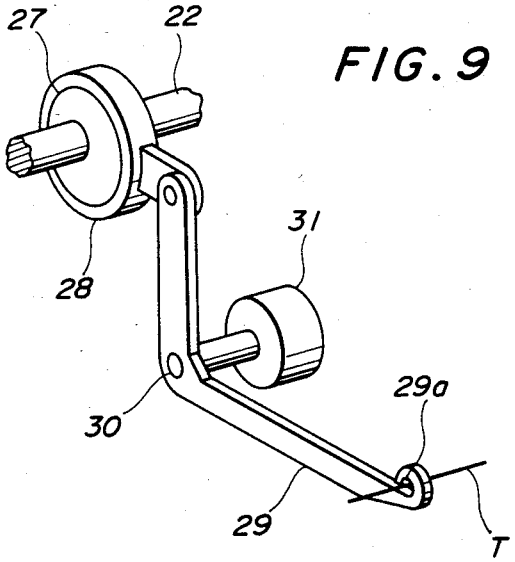
FIG. 9 is a schematic perspective view of a third embodiment of the thread feed device in a sewing machine constructed in accordance with the principle of the present invention.
Figure 10:
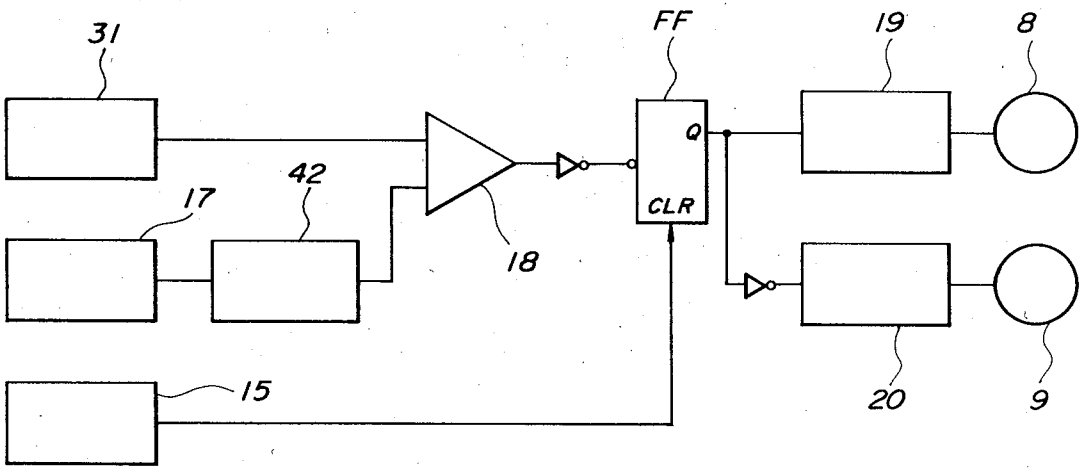
FIGS. 10 and 12 are block diagrams of alternate embodiments of the electrical circuit for the third embodiment of the thread feed device shown in FIG. 9.
Figure 11:
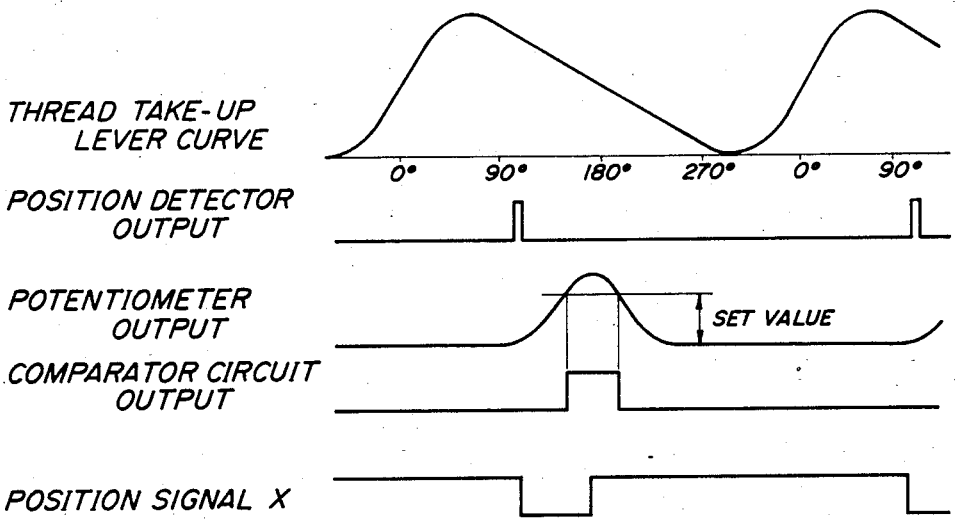
FIGS. 11 and 13 are time charts showing the operation of the electrical circuits of FIGS. 10 and 12, respectively.

Now referring to FIGS. 9, 10 and 11 in which the third embodiment of the thread feed device of the present invention is shown, in FIG. 9, reference numeral 27 denotes a regularly circular eccentric cam secured to the main shaft 22 eccentric to the shaft and has a ring 28 mounted on the outer surface of the cam for rotation thereabout. Reference numeral 29 denotes a paying-out member corresponding to the paying-out members 10 and 23 in the first and second embodiments, respectively. The paying-out member 29 has one end formed with a thread eyelet 29*a* and the other end pivoted to the ring 28. The paying-out member 29 is also pivoted at an intermediate point between the opposite ends thereof to a shaft 30 which extends in parallel to the main shaft 22 for rotation about the shaft 30. Reference numeral 31 denotes a potentiometer or paying-out detector corresponding to the paying-out detector in the foregoing embodiments and adapted to produce a voltage the magnitude of which corresponds to the rotation position of the shaft 30. Reference numeral 42 denotes a digital-to-analogue converter adapted to convert a digital signal from the setting device 17 to an analogue value, reference numeral 18 denotes a comparator circuit (comparator) adapted to compare the output of the D/A converter 42 with the output of the potentiometer 31 and produce a coincidence signal when the outputs of the converter and potentiometer coincide with each other. The remaining components of the third embodiments are similar to the corresponding components in the foregoing embodiments and thus, description on the corresponding components will be omitted herein.

Figure 12:
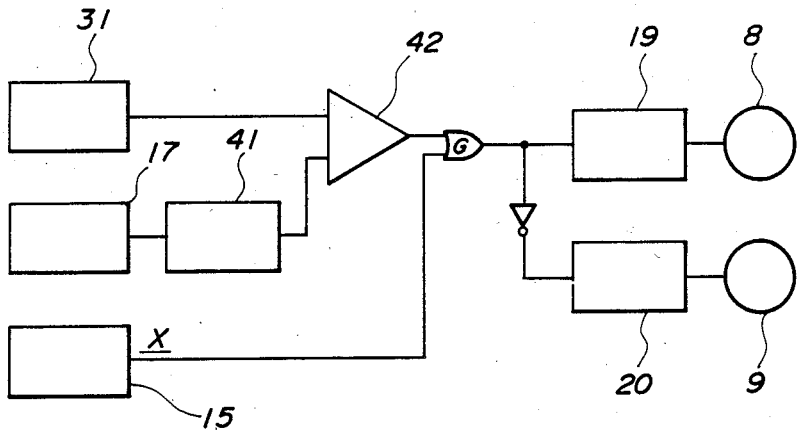
Figure 13:
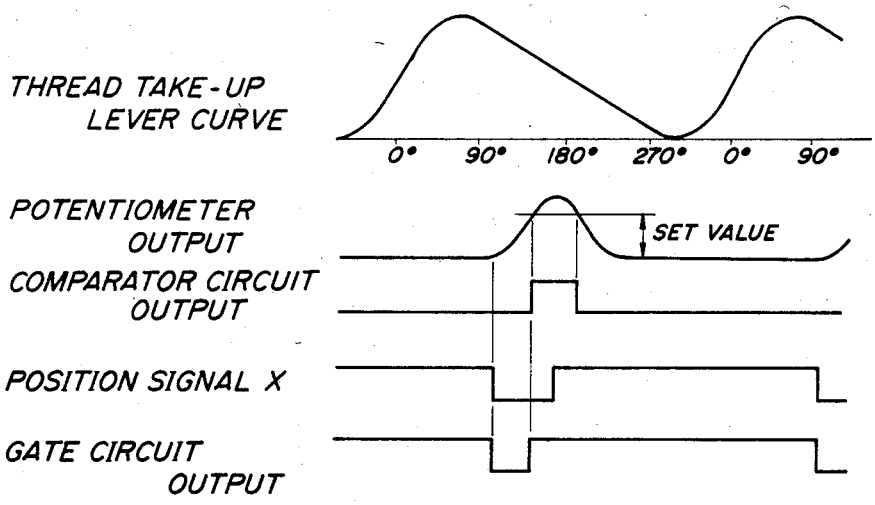

In the third embodiment of the thread feed device of the invention shown in FIGS. 9 through 11, the potentiometer 31 indirectly detects the paying-out amount of the thread T and the electrical circuit for the third embodiment may be modified as shown in FIG. 12. In the modified electrical circuit, the position detector 15 produces a position signal X instead of the detected position signal to be produced in the electrical circuit of FIG. 11, the position signal X is input to an OR gate circuit G together with the output of the above-mentioned comparator circuit 18 and the output of the OR gate circuit G is input to the operation circuits 19, 20 like the output of the FF in FIG. 10.

Figure 14:
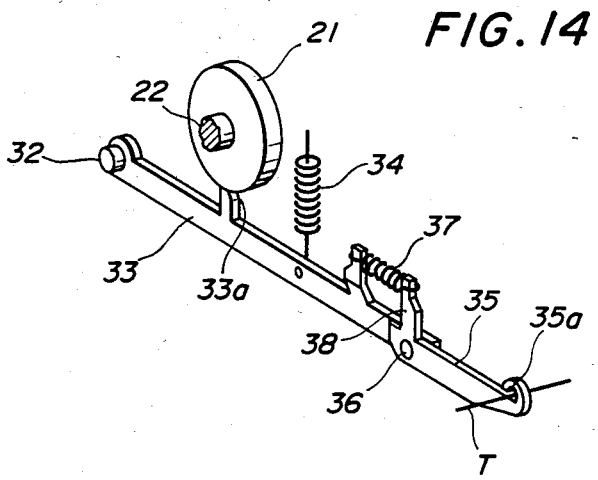
FIG. 14 is a schematic perspective of fourth embodiment of the thread feed device in a sewing machine constructed in accordance with the principle of the present invention.

Now referring to FIG. 14 in which the fourth embodiment of the thread feed device of the invention is shown and the fourth embodiment is a modification of the second embodiment. In the fourth embodiment, an interlocking member 33 is rotatably supported at one end by a shaft 32 extending in parallel to the main shaft 22 and has a projection 33*a* extending upwardly in an intermediate position between the opposite ends thereof and a coil spring 34 is anchored at the opposite ends to the machine frame and interlocking member to normally urge the projection 33*a* against the outer surface of the cam member 21. The free end of the interlocking member 33 pivotally supports an intermediate point between the opposite ends of an L-shaped paying-out member 35 by means of a pivot pin 36 and one end of the paying-out member formed with a thread eyelet 35*a*. The interlocking member and paying-out member are integrally connected together by means of a coil spring 37 and a stopper 38. The remaining components of the fourth embodiment are similar to the corresponding components of the second embodiment and description on the similar components will be omitted herein. In the fourth embodiment, the force of the coil spring 34 is designed greater than that of the coil spring 25 in the embodiment shown in FIG. 6 so that the interlocking member 33 can positively follow the cam member 21 and the force of the coil spring 37 is designed less than that of the coil spring 25 in the embodiment of FIG. 5 so that when the paying amount of the thread T reaches a predetermined value to thereby energize the two electromagnets 8, 9, the paying-out member 35 can be positively held in position even with a low tension on the thread T.

As mentioned hereinabove, according to the present invention, the thread feed device in a sewing machine essentially comprises a paying-out member 10 (23, 29, 35) positioned in the thread path extending between the thread supply source and the needle for operation in synchronism with the thread take-up lever to minimize the length of said thread path before the thread take-up lever applies a highest tension to the thread after the thread path has been increased in its length when the lever was in other positions; two separate holding means 6 and 7 positioned upstream and downstream of said paying-out member, respectively, in the thread path for arresting the movement of said thread when said holding means are actuated and for allowing the thread to advance when the means are in inoperative condition; and a control circuit operable to render said upstream holding means inoperative before said paying-out member increases the length of said thread path and actuate the upstream holding means when the thread has been payed out of said thread supply source by a predetermined amount and operate said downstream holding means when at least said upstream holding means is in its inoperative condition and render said downstream holding means when said thread take-up lever is in its tension applying position. With the above-mentioned arrangement of the essential components of the thread feed device of the invention, the thread is precisely fed in an amount required for forming one stitch each time one stitch has been formed and thus, the thread length for each stitch is maintained in a constant tension to thereby give a fine appearance to the stitch resulting in a high quality sewn product.

In the foregoing embodiments, although reference data relating to the length or amount of the thread required for forming one stitch is set by manually operating a digital switch, thread amount data may be read from a memory in which the data have been previously stored by data relating to the set position of needle stroke adjusting means and feed adjusting menas detected by known detector means or detected data relating to the displacement of needle stroke and feed adjusting devices and the read data can be employed as reference data relating to thread paying-out amount or data obtained by the computation based on the above-mentioned detected data may be input to the comparator circuit 18 as reference data relating to paying-out amount of the thread. In a sewing machine in which the needle stroke and feed mechanisms are controlled based on sewing data memorized in a memory in relation to each stitch to be sewn on sewing data, stored thread amount data are merely read from the memory or data obtained by the computation of the above-mentioned sewing data may be input to the comparator circuit 18 as data relating to the paying-out amount of the thread.

And in addition to data relating to needle stroke and work feed, thread feed amount may be set by composing data relating to the variation in position of the presser foot depending upon work thickness detected by the potentiometer and data obtained through experiments conduced on various types of threads and ways of weaving work pieces.

In the first embodiment, as shown in FIG. 5, although the electromagnets 8 and 9 are so designed that while one of the magnets is in its energized condition the other magnet is in its deenergized condition, the two electromagnets may be so designed that the holding means 7 releases the thread T overcoming the resistance of the base tension 12 and the electromagnets 8 and 9 are energized at the timing as shown in the second embodiment of FIG. 8.

In this way, even if the thread has been payed out of the bobbin by a predetermined amount and the electromagnets 8 and 9 has been energized before the larger diameter portion 10*a* of the paying-out member 10 faces the thread T, since the thread T is merely moved from the thread take-up lever back towards the paying-out member by the action of the paying-out member rather by the holding means 7 and will not be applied a high tension thereto and/or payed out strongly.

Although the paying-out member 10 in FIG. 1 (the first embodiment), the cam member 21 in FIG. 6 (the second embodiment), the eccentric cam 37 in FIG. 9 (the third embodiment) and the cam member 31 in FIG. 12 (the fourth embodiment) are shown as rotating in one direction in response to the rotation of the main shaft, the components may rock in response to the rotation of the main shaft or may be rotated or rocked by any other suitable drive which operates in synchronism with the main shaft.

In the first embodiment, the paying-out member 10 is formed like the cam member 21 in the second embodiment and be rotated at an angular velocity. On the contrary, the cam member 21 in the second and fourth embodiments may be formed in the shape of an oval like the paying-out member 10 in the fourth embodiment and rotated at an angular velocity one half of the rotation velocity of the main shaft.

In the first embodiment, the holding means 6 and rotary member 13 are so arranged that the thread T supplied from the supply source is first wound about the rotary member 13 and then about the holding means 6 and passed to the thread take-up lever 4 (FIG. 1) and in the second embodiment, the thread T supplied from the supply source is once wound about the holding means 6, about the rotary member 13 and again about the holding means 6. However, the arrangement may be reversed if desired and the position of the holding means 6 and rotary member 13 may be reversed in the first embodiment.

In the foregoing embodiments, although the sets of the clamp members 6*a*, 6*b* and 7*a*, 7*b* pinch or release the thread T when their associated electromagnets 8 and 9 are energized, it is also contemplated that a plurality of radial projections are formed about the outer periphery of a disc adapted to rotate about a fixed axis, the free ends of the projections are alternately bent in two directions along the axis of rotation of the disc and the thread is alternately wound about the projections whereby when the electromagnets are in their deenergized condition the disc is allowed to rotate so as to move the thread and when the electromagnets are in their energized condition the disc is held stationary to arrest the movement of the thread.

In the foregoing description has been made of preferred embodiments of the invention, but it will readily occur to those skilled in the art that these are illustrative in nature, but do not limit the scope of the invention in any way. The scope of the invention is only limited to the appended claims.

What is claimed is:

1. A thread feed apparatus for use in a sewing machine having a thread take-up lever movable in thread tensioning and slackening directions and a thread supply source with at least a portion of a thread feed path extending between the thread supply source and the take-up lever, said apparatus comprising first holding means for gripping the thread at a first location along the thread feed path, said first holding means being operable between an engaged condition in which said first holding means grips a portion of the thread and holds the gripped portion of the thread against movement and a disengaged condition in which said first holding means is ineffective to grip the thread, second holding means for gripping the thread at a second location along the thread feed path, said second holding means being operable between an engaged condition in which said second holding means grips a portion of the thread and holds the gripped portion of the thread against movement and a disengaged condition in which said second holding means is ineffective to grip the thread, control means for operating said first holding means between the engaged and disengaged conditions and for maintaining said first holding means in the disengaged condition during at least a portion of the movement of the thread take-up lever in a thread slackening direction, said control means including means for maintaining said second holding means in the engaged condition while said first holding means is in the disengaged condition, thread paying-out means engageable with the thread at a location between said first and second holding means for increasing the length of the thread path between said first and second holding means while said first holding means is in the disengaged condition and said second holding means is in the engaged condition, and thread paying-out detection means connected with said control means and disposed in engagement with the thread at a location upstream of said thread paying-out means for detecting when the thread path between said first and second holding means has increased by a predetermined amount, said control means including means for effecting operation of said first holding means from the disengaged condition to the engaged condition in response to said thread paying-out detection means detecting that the thread path between said first and second holding means has increased by the predetermined amount.

2. A thread feed apparatus as set forth in claim 1 further including spring means for applying force to the thread at a location between said first and second holding means to tension the thread in the increased length of the thread path between said first and second holding means upon operation of said first holding means from the disengaged condition to the engaged condition with said second holding means in the engaged condition.

3. An apparatus as set forth in claim 1 wherein said thread paying-out means includes a thread paying-out member disposed in engagement with the thread at a location between said first and second holding means, means for moving said thread paying-out member to increase the length of the thread path between said first and second holding means while said first holding means is in the disengaged conditioned and said second holding means is in the engaged condition, and means for applying a biasing force to said thread paying-out member to tension the thread in the increased length of the thread path between said first and second holding means when said first and second holding means are in the engaged condition.

4. An apparatus as set forth in claim 3 wherein said means for moving said thread paying-out member includes a cam, a cam follower connected with said thread paying-out member, and drive means for rotating said cam, said means for applying a biasing force to said thread paying-out member including spring means for pressing said cam follower against said cam during rotation of said cam while said first holding means is in the disengaged condition and for pressing said thread paying-out member against the thread while said first and second holding means are in the engaged condition.

5. An apparatus as set forth in claim 3 wherein said thread paying-out member includes first section, a second section which engages the thread and connector means for pivotally interconnecting said first and second sections, said means for applying a biasing force to said thread paying-out member including a spring for holding said first and second sections against pivota1 movement while said first holding means is in the disengaged condition and for applying a biasing force to said second section while allowing pivotal movement to occur between said first and second sections when said first and second holding means are in the engaged condition.

6. An apparatus as set forth in claim 1 wherein said thread paying-out means includes a rotatable disc-shaped thread paying-out member having large and small diameter portions, and means for rotating said disc-shaped member to move the large diameter portion of said disc-shaped member into engagement with the thread at a location between said first and second holding means while said first holding means is in the disengaged condition and said second holding means is in the engaged condition.

7. An apparatus as set forth in claim 1 wherein said control means includes detector means for detecting when the thread take-up lever reaches a predetermined position and means for effecting operation of said first holding means from the engaged condition to the disengaged condition in response to said detector means detecting that the thread take-up lever has reached the predetermined position.

* * * * *